US006151759A

United States Patent [19]

Harward

[11] Patent Number: 6,151,759

[45] Date of Patent: Nov. 28, 2000

[54] FINGER RINGS FOR A WATER SKI BOOT

[76] Inventor: Norris K. Harward, 6689 Devinney Ct., Arvada, Colo. 80004

[21] Appl. No.: 09/184,678

[22] Filed: Nov. 2, 1998

[51] Int. Cl.[7] ..... A45F 5/10; F16L 5/00; E05D 15/00

[52] U.S. Cl. ..... 16/444; 16/2.1; 16/87.2; 16/446

[58] Field of Search ..... 16/2.1, 87.2, 422, 16/444, 446, DIG. 19; 24/713.6, 714.6, 714.8; 441/70; 2/265; 411/338, 339, 84

[56] References Cited

U.S. PATENT DOCUMENTS

| | | | |
|---|---|---|---|
| 3,328,854 | 7/1967 | Tombari | 16/2.1 |
| 4,372,013 | 2/1983 | Gautier, Jr. | 244/713.6 |
| 5,069,586 | 12/1991 | Casey | 411/339 |
| 5,111,868 | 5/1992 | Sawaya | 16/87.2 |
| 5,647,107 | 7/1997 | Brewster | 24/713.6 |

*Primary Examiner*—Chuck Y. Mah
*Attorney, Agent, or Firm*—Edwin H. Crabtree; Ramon L. DiZarro; Donald W. Margolis

[57] ABSTRACT

A pair of finger rings used for mounting around finger holes in a rubber boot used with a water ski, a wake board and the like. The two finger rings include a first annular mounting plate and a second annular mounting plate. The two mounting plates are identical in structure. The first and second mounting plates include a first ring hole and a second ring hole. The first and second ring holes are dimensioned for indexing around the finger holes in the boot. The two mounting plates include a plurality of outwardly extending male posts and female posts. The male posts on the first mounting plate are dimensioned for receipt in the female posts of the second mounting plate. Likewise, the male posts of the second mounting plate are dimensioned for receipt in the female posts of the first mounting plate. During installation of the finger rings, the first mounting plate is positioned on one side of rubber boot with the first and second ring holes disposed next to and around the finger holes in the boot. The second mounting plate is positioned on the other side of the rubber boot with the first and second ring holes disposed next to and around the finger holes. The male and female posts of the first and second mounting plates are then pushed into the rubber boot for locking engagement and securing the finger rings to the rubber boot.

7 Claims, 2 Drawing Sheets

FINGER RINGS FOR A WATER SKI BOOT

BACKGROUND OF THE INVENTION (a) Field of the Invention

This invention relates to finger rings and more particularly, but not by way of limitation, to finger rings used to protect and prevent the tearing of finger holes in a rubber boot and fix existing tears. The rubber boot used on a water ski, wake board and other outdoor sport applications where finger holes are used to help in inserting a foot in a flexible boot.

(b) Discussion of Prior Art

In U.S. Pat. No. 3,279,015 to Henning et al., a shoelace apparatus is described wherein a release tab is shown and used with shoelace holes in conventional laced shoes. In U.S. Pat. No. 4,624,060 to Maxwell, a system for attaching pairs of shoes together is described wherein fastening tabs are illustrated with a threaded fastener received through holes in the fastening tabs. In U.S. Pat. Nos. 3,175,307 and 3,097,438 to Evans two different types of shoe attachments and accessories for shoes are described for assisting in the placement of the foot into the heel of a shoe.

None of the above mentioned prior art patents describe or illustrate the unique combination of structure and function of the subject finger rings used with finger holes disposed in rubber boots used on water skis and the like.

SUMMARY OF THE INVENTION

In view of the foregoing, it is a primary object of the subject invention to provide finger rings to prevent the tearing or ripping apart of finger holes in a rubber boot. Also, the invention can be used to fix existing tears. The rubber boot used on sporting equipment such as a water ski, a wake board and similar types of items.

Another object of the finger rings is to provide the user of a rubber boot an inexpensive yet effective way of protecting finger holes from damage for increased life of the boot.

Still another object of the invention is the finger rings are easy to apply and can be used prior to the finger holes being damage or after the sides of the finger holes have become torn and the sides of the finger holes need to be held in place.

The finger rings include a first annular mounting plate and a second annular mounting plate. The two mounting plates are identical in structure. The first and second mounting plates include a first ring hole and a second ring hole. The first and second ring holes are dimensioned for indexing around the finger holes in the boot. The two mounting plates include a plurality of outwardly extending male posts and female posts. The male posts on the first mounting plate are dimensioned for receipt in the female posts of the second mounting plate. Likewise, the male posts of the second mounting plate are dimensioned for receipt in the female posts of the first mounting plate. During installation of the finger rings, the first mounting plate is positioned on one side of rubber boot with the first and second ring holes disposed next to and around the finger holes in the boot. The second mounting plate is positioned on the other side of the rubber boot with the first and second ring holes disposed next to and around the finger holes. The male and female posts of the first and second mounting plates are then pushed into the rubber boot for locking engagement and securing the finger rings to the rubber boot.

These and other objects of the present invention will become apparent to those familiar with different types of flexible boots and finger holes used in the boots for assisting in inserting a foot therein when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
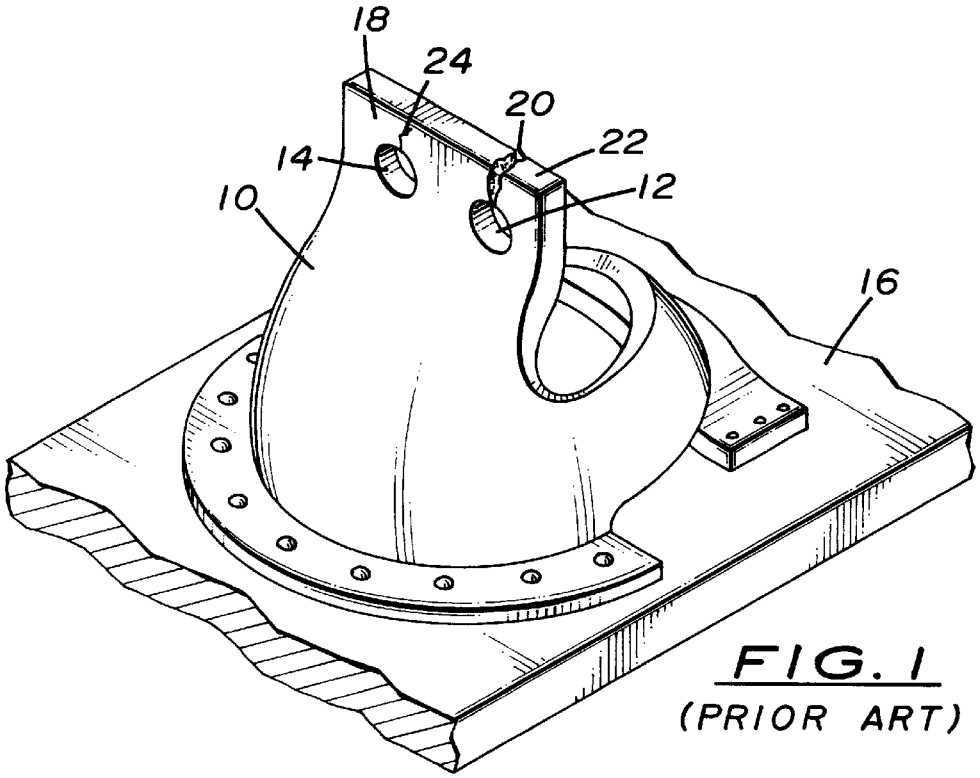
FIG. 1 (PRIOR ART)
FIG. 1 is a rear perspective view of a prior art rubber boot with a pair of finger holes in the boot. The boot is mounted on top of a water ski. The finger holes are used for helping the user of water ski to insert his or her foot inside the boot. In this illustration, the top of the finger hole on the right has been torn completely through to a top edge of the boot. The finger hole on the left has just begun to tear upwardly toward the top of the boot.

In FIG. 1, a rear perspective view of a prior art rubber boot 10 is shown with a pair of finger holes 12 and 14 in the boot 10. The boot 10 in this drawing is shown mounted on top of a water ski 16. Only a portion of the water ski 16 is shown in the drawings. While the water ski 16 is shown in the drawings, it should be kept in mind that the subject invention can be used equally well with finger holes in boots used on wake boards and other sport related equipment. The boot 10 is normally attached to a boot mounting plate which is used for securing the boot to the top of the water ski 16. The boot mounting plate is not shown in the drawings.

The finger holes 12 and 14 are used for helping the user of water ski 16 to insert his or her foot inside the boot 10. In this illustration, a top portion 18 of the boot 10 and above the finger hole 12 has a tear 20 torn completely through to a top edge 22 of the boot 10. The finger hole 14 on the left has a tear 24 just starting upwardly into the top portion 18 of the boot 10.

Figure 2:
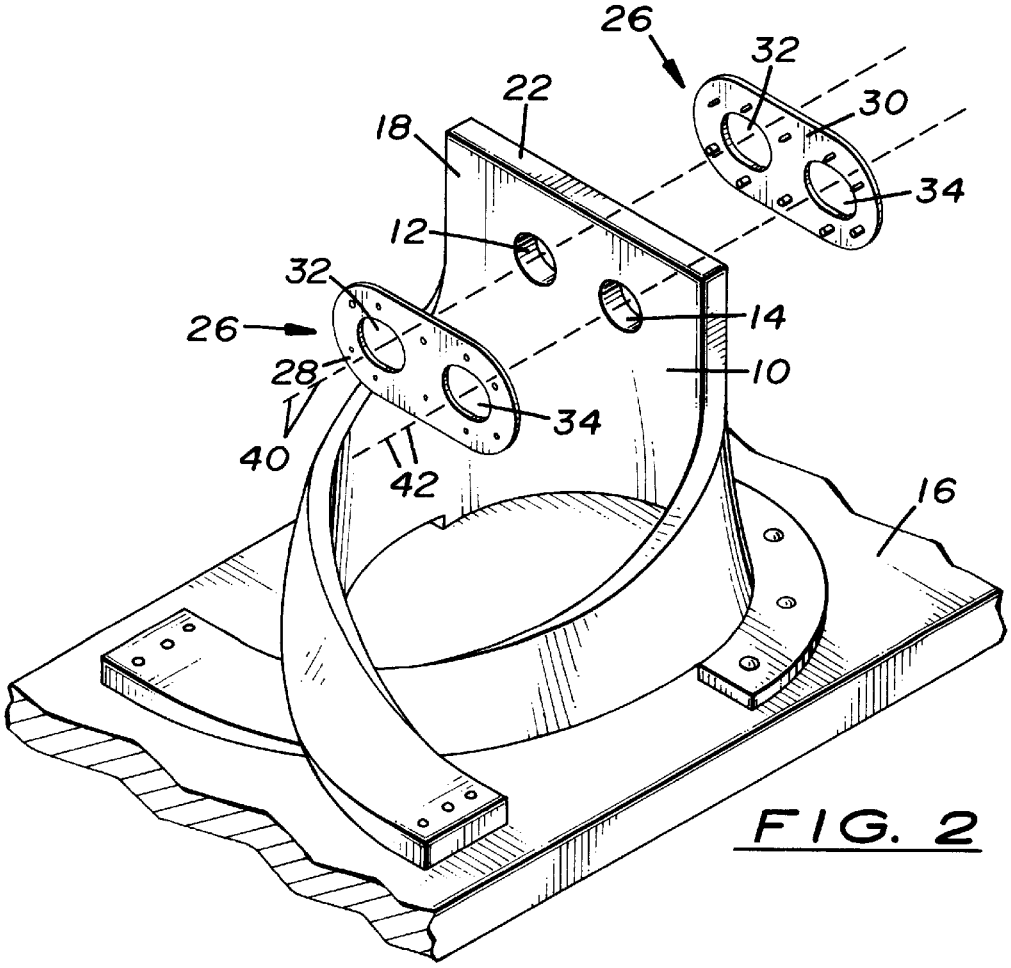
FIG. 2 is a front perspective view of the rubber boot with the subject finger rings disposed in front of the finger holes in the boot and at the rear of the finger holes. The finger rings are shown ready for attachment to the rubber boot.

In FIG. 2, a front perspective view of the rubber boot 10 is shown with the subject finger rings having general reference numeral 26. The finger rings 26 include a first annular mounting plate 28 and a second annular mounting plate 30. Two mounting plates 28 and 30 are identical in structure for ease in manufacturing and installation. The first and second mounting plates 28 and 30 include a first ring hole 32 and a second ring hole 34. The first and second ring holes 32 and 34 are dimensioned for indexing around the finger holes 12 and 14 in the boot 10.

The two mounting plates 28 and 30 include a plurality of outwardly extending male posts 36 and female posts 38. The male posts 36 on the first mounting plate 28 are dimensioned for receipt in the female posts 38 of the second mounting plate 30. Likewise, the male posts 36 of the second mounting plate 30 are dimensioned for receipt in the female posts 38 of the first mounting plate 28. The male posts 36 and female posts 38 are shown more clearly in FIGS. 3–5. In FIG. 2, a pair of dashed lines 40 and 42 are shown for aligning the finger holes 12 and 14 with the ring holes 32 and 34 of the two mounting plates 28 and 30.

Figure 3:
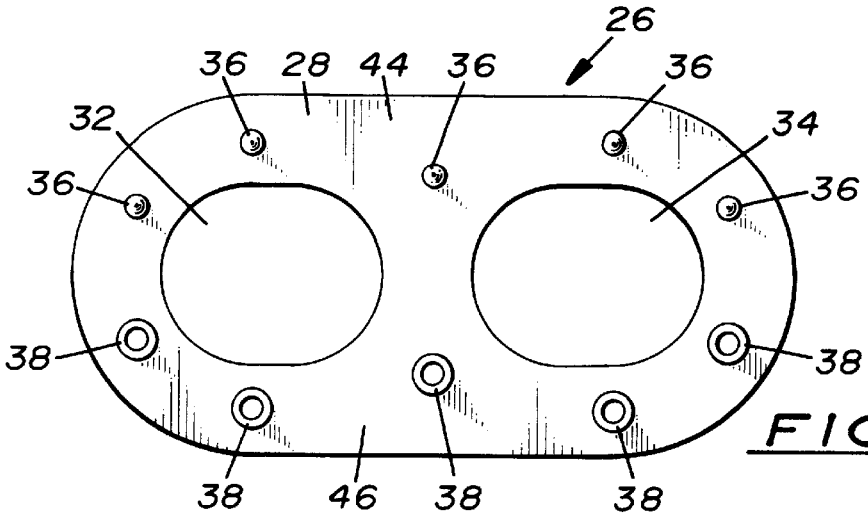
FIG. 3 is a top view of one of the mounting plates making up the finger rings. The mounting plate includes a first and a second ring hole and upwardly extending male and female posts. The posts are used for inserting into the soft flexible rubber material used in the rubber,boot construction.

In FIG. 3, a top view of the first mounting plate 28 is illustrated which makes up one half of the finger rings 26. The first mounting plate 28 includes the first ring hole 32 and the second ring hole 34. The ring holes 32 and 34 are slightly oval in shape and are generally in a range of 1 to 1½ inches in diameter. The size of the ring holes 32 and 34 may vary depending on the diameter of the finger holes 12 and 14 with the ring holes designed to be larger than the diameter of the finger holes so that the comfort of the soft rubber boot material is used for engagement when the fingers of the hand of the user are inserted through the ring holes 32 and 34.

In this drawing, the upwardly extending male posts 36 and female posts 38 are illustrated. The number of posts 36 and 38 may vary and in this example five equally spaced male posts 36 are disposed in a top portion 44 of the first mounting plate 28 and five equally spaced female posts 38 are disposed in a bottom portion 46 of the first mounting plate 28. Since the mounting plates 28 and 30 are identical in structure, it can be appreciated that by rotating the second mounting plate 180 degrees, the female posts 38 of the second mounting plate 30 can be used for engaging the male posts 36 of the first mounting plate 28. Likewise, the male posts 36 of the second mounting plate 30 can be used for engaging the female posts of the first mounting plate 28. This important feature is shown in FIG. 5.

Figure 4:
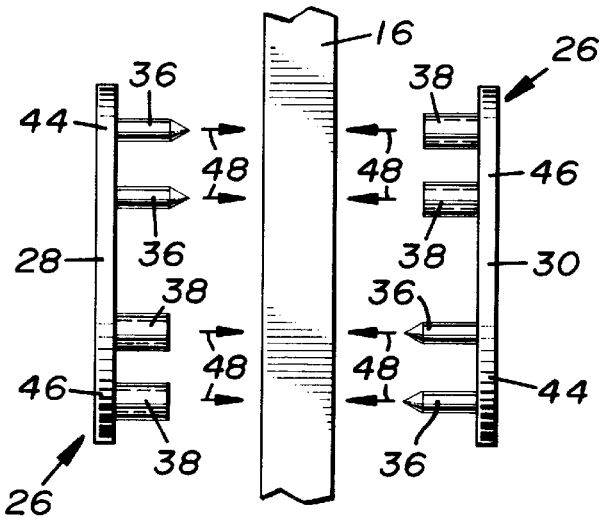
FIG. 4 is a side view of a portion of the rubber boot disposed between the first and the second mounting plates. The mounting plates are positioned for insertion into the rubber boot as indicated by arrows.

In FIG. 4, a side view of a portion of the rubber boot 10 is shown disposed between the first and the second mounting plates 28 and 30. The thickness of the rubber boot 10 is generally in a range of ⅜ inches. The mounting plates 28 and 30 are positioned for insertion into the rubber boot 10 as indicated by arrows 48. During installation of the finger rings 26, the first mounting plate 28 is positioned on one side of rubber boot 10 as shown in FIG. 4 with the first and second ring holes 32 and 34 disposed next to and around the finger holes 12 and 14 in the boot 10. The second mounting plate 30 is positioned on the opposite side of the rubber boot 10 as shown in this drawing with the first and second ring holes 32 and 34 disposed next to and around the finger holes 12 and 14.

Figure 5:
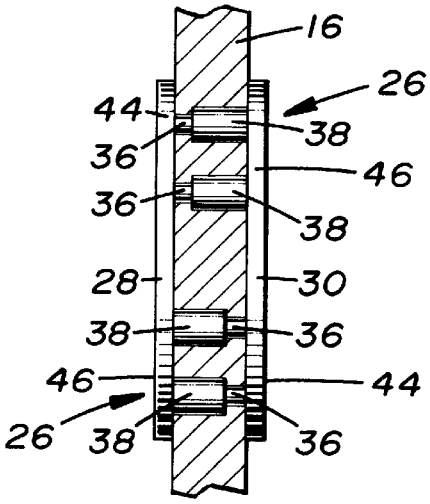
FIG. 5 is a side view of a portion of the rubber boot similar to FIG. 4 but with the first and second mounting plates inserted into the rubber boot with the male posts received inside the female posts in a press fit.

In FIG. 5, a side view of a portion of the rubber boot 10 is shown and similar to FIG. 4. In this drawing, the first and second mounting plates 28 and 30 are shown with the male posts 36 and the female posts 38 of the plates inserted into opposite sides of the rubber boot 10. The male posts 36 are shown engaged inside a portion of the female posts 38 in a press fit. While the male and female posts 36 and 38 are shown in the drawings, it should be kept in mind that various types of fastening devices can be used equally well for securing the mounting plates 28 and 30 to the sides of the rubber boot 10.

Figure 6:
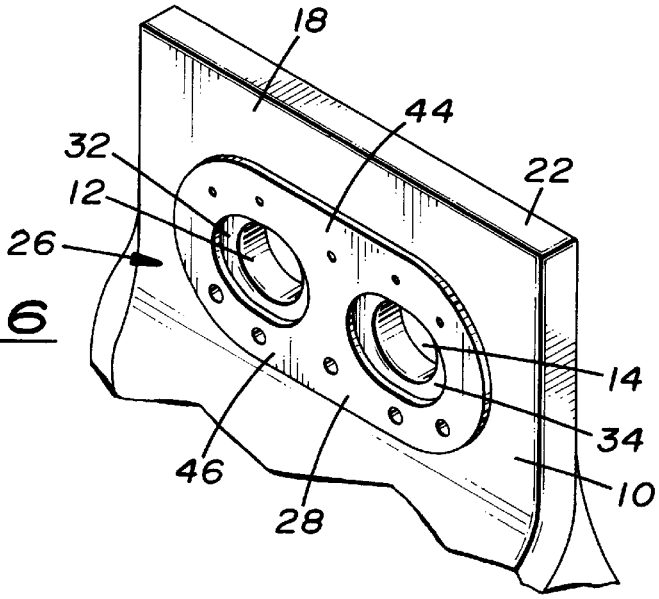
FIG. 6 is a front perspective view of a portion of the rubber boot with the first and second mounting plates installed thereon with first and second ring holes of the mounting plates surrounding and protecting the finger holes in the rubber boot.

In FIG. 6, a front perspective of a portion of the rubber boot 10 is shown with the first and second mounting plates 28 and 30 installed thereon. In this illustration, the first and second ring holes 32 and 34 of the first mounting plate 28 are shown surrounding and protecting the finger holes 12 and 14 from damage on the rubber boot 10.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. Finger rings used for mounting around a pair of finger holes in a rubber boot, the boot used with a water ski, a wake board and the like, the finger rings comprising;

a first mounting plate with a first ring hole and a second ring hole therein, said first ring hole and said second ring hole adapted for receipt next to and around the circumference of one side of the finger holes in the rubber boot;

a plurality of male posts and female posts attached to and extending outwardly from said first mounting plate;

a second mounting plate with a first ring hole and a second ring hole therein, said first ring hole and said second ring hole adapted for receipt next to and around the circumference of an opposite side of the finger holes in the rubber boot; and a plurality of male posts and female posts attached to and extending outwardly from said second mounting plate.

2. The finger rings as described in claim 1 wherein said male posts on said first mounting plate are adapted for receipt in the female posts on said second mounting plate, said male posts on said second mounting plate are adapted for receipt in the female posts on said first mounting plate.

3. A finger ring used for mounting around a first finger hole and a second finger hole in a rubber boot, the boot used with a water ski, a wake board and the like, the finger ring comprising;

a first mounting plate with a first ring hole and a second ring hole therein, said first ring hole adapted for receipt around the circumference of one side of the first finger hole in the rubber boot, said second ring hole adapted for receipt around the circumference of one side the second finger hole in the rubber boot; and means for securing said first mounting plate to the rubber boot, said means for securing attached to said first mounting plate and extending outwardly therefrom.

4. The finger ring as described in claim 3 wherein said means for securing includes a plurality of male posts and female posts attached to and extending outwardly from said first mounting plate.

5. The finger ring as described in claim 3 further including a second mounting plate with a first ring hole and a second ring hole therein, said first ring hole and said second ring hole adapted for receipt next to and around the circumference of an opposite side of the first and second finger holes in the rubber boot and means for securing said second mounting plate to the rubber boot, said means for securing attached to said second mounting plate and extending outwardly therefrom.

6. The finger ring as described in claim 5 wherein said means for securing said first and second mounting plates includes a plurality of male posts and female posts attached to and extending outwardly from said first mounting plate and said second mounting plate.

7. The finger rings as described in claim 6 wherein said male posts on said first mounting plate are adapted for receipt in the female posts on said second mounting plate, said male posts on said second mounting plate are adapted for receipt in the female posts on said first mounting plate.

* * * * *